US006533271B1

(12) United States Patent
Zimmermann

(10) Patent No.: US 6,533,271 B1
(45) Date of Patent: Mar. 18, 2003

(54) SWITCH POINT FOR FLAT, FLEXIBLE POSTAL ARTICLES IN SORTING MACHINES

(75) Inventor: Armin Zimmermann, Constance (DE)

(73) Assignee: Siemens Production and Logistics Systems AG, Nürnberg (DE)

( * ) Notice: Subject to any disclaimer, the term of this patent is extended or adjusted under 35 U.S.C. 154(b) by 0 days.

(21) Appl. No.: 09/830,483

(22) PCT Filed: Oct. 1, 1999

(86) PCT No.: PCT/DE99/03167

§ 371 (c)(1),
(2), (4) Date: Apr. 27, 2001

(87) PCT Pub. No.: WO00/24661

PCT Pub. Date: May 4, 2000

(30) Foreign Application Priority Data

Oct. 28, 1998 (DE) ..... 198 49 748

(51) Int. Cl.[7] ..... B65H 39/10
(52) U.S. Cl. ..... 271/303
(58) Field of Search ..... 271/303

(56) References Cited

U.S. PATENT DOCUMENTS 4,251,000 A 2/1981 Templeton
5,150,894 A 9/1992 Ricciardi
5,979,891 A * 11/1999 Roux ..... 271/303 X
6,129,352 A * 10/2000 Stab ..... 271/303 X
6,176,485 B1 * 1/2001 Wingate ..... 271/303

FOREIGN PATENT DOCUMENTS

| | | |
|---|---|---|
| DE | 4317042 | 8/1994 |
| DE | 19604090 | 8/1994 |
| EP | 0255684 | 2/1988 |
| GB | 2023104 | 12/1979 |

* cited by examiner

*Primary Examiner*—David H. Bollinger
(74) *Attorney, Agent, or Firm*—Venable, LLP; Robert Kinberg

(57) ABSTRACT

Switch for flat, flexible mail items in a mail item sorting machine, wherein the mail items are transported off while clamped between two conveyor belts. According to the invention, the deflection element consists of two rigid partial deflection elements (1, 2) with a joint pivoting axis (3), which elements are positioned side-by-side in conveying direction and are fixedly connected outside of the letter flow. The joint pivoting axis (3) is located in the frontal part of the switch region, as seen in conveying direction, and away from the conveying belts (4, 5) that continue on diverging paths in the switch region. Depending on the switch position, the respective mail item, is guided in the chosen direction between one of the two partial deflection elements (1, 2) and the respective outer conveying belt (4, 5). The other partial deflection element (1, 2) in that case is completely located outside of the conveying belts (4, 5) that diverge in the switch region.

3 Claims, 3 Drawing Sheets

SWITCH POINT FOR FLAT, FLEXIBLE POSTAL ARTICLES IN SORTING MACHINES

Figure 1:
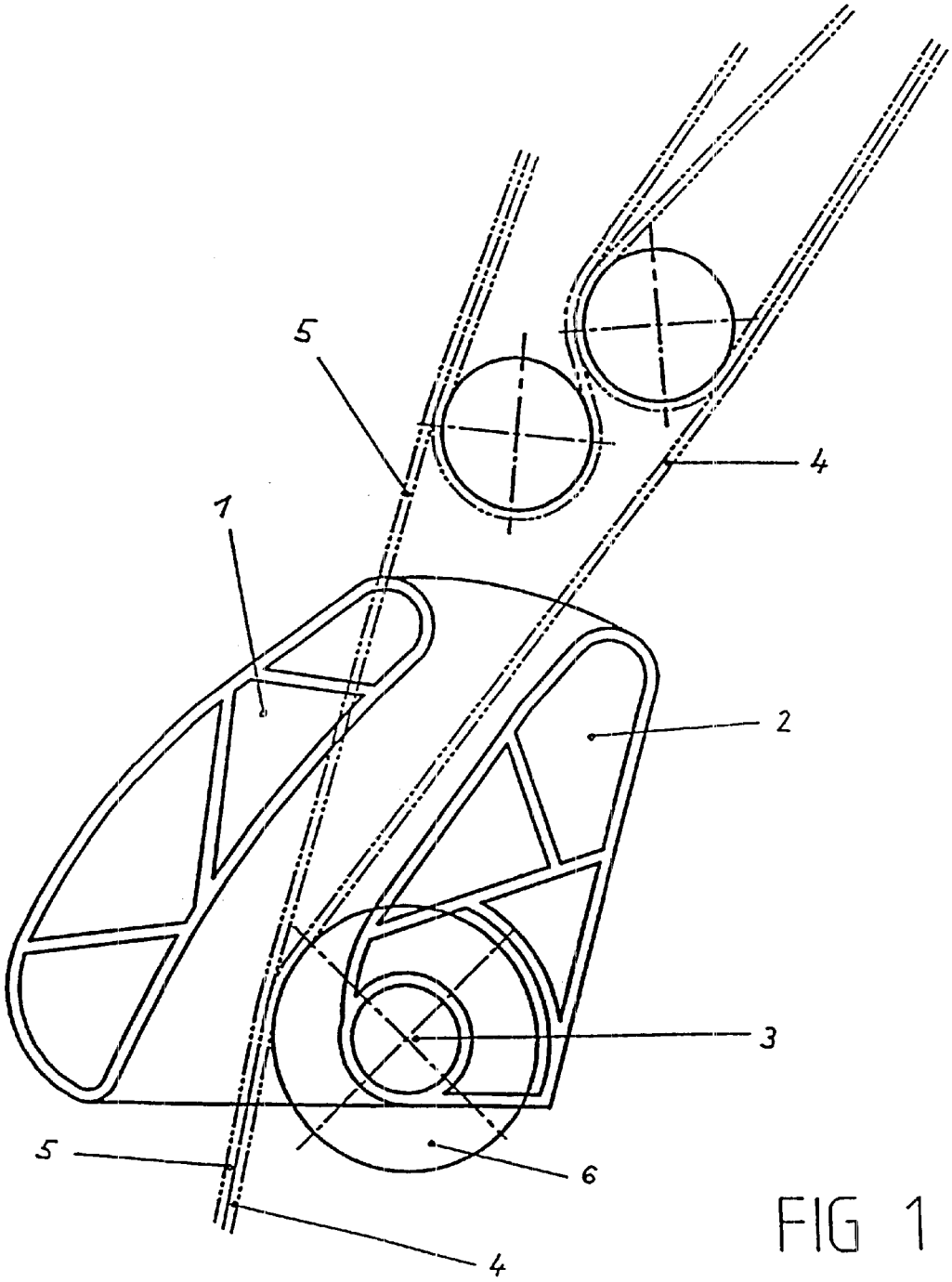

The invention relates to a switch for flat, flexible mail items in mail item sorting machines, in accordance with the preamble to claim 1.

These switches guide the mail items in a controlled manner to the respective conveying paths and sorting compartments of the mail item sorting machines. In the process, the mail items are conveyed along the conveying paths while clamped between two conveyor belts of a twin belt system. The width of the conveyor belts is less than the height of the mail items. With known switches of this type, the pivoting bearing of a wedge-shaped guide element pointing counter to the conveying direction is provided at the end of the switch region, in conveying direction between the two intakes of the twin belt system for transporting off. Depending on the pivoting position, this guide element forms a channel for the mail items between its side wall in the respective outer continuous transport belt.

[1]Note: This sentence is unclear.

Curved or bent mail items in particular can bump against the pivoting bearing while moving through the switch region, thus causing a malfunction. The deflection element must be in its respective end position before a mail item enters the switch to ensure an orderly operating sequence in the sorting machine. If the spacing between mail items is to be kept as small as possible for a high machine throughput, the deflection elements of the switches would have to be switched before the preceding mail item has left the switch. point. This is possible to a limited degree only since the preceding mail item is pressed with its back area against a conveyor belt during an early switching, thereby causing either the destruction of the mail item or preventing the switch from switching as required.

Thus, it is the object of the invention as specified in claim 1 to create a switch of the generic type, which has lower malfunction rates as compared to known switches and permits smaller minimum distances between mail items.

Contact between the mail items and the pivoting axis is avoided if two fixedly connected, rigid partial deflection elements are used, which guide the mail items between them. The pivoting axis is arranged to the side, away from the conveyor belts that diverge in the switch region, as seen from the start of the switch and in conveying direction. A further advantage is that even with very small distances between the mail items and a pivoting of the deflection element to the other conveying direction, which may be required before the preceding mail items have left the switch, the backs of the preceding mail items are not pushed against the conveying belts, resulting in the previously described negative effects, but are freely redirected away from the conveying belts.

One advantageous embodiment according to claim 2 provides that the axis of a deflection roller, on which the endless conveying belts are deflected at the start of the switch region to the branching-off directions, simultaneously functions as the pivoting axis for the deflection element.

According to claim 3, it is advantageous if a controllable rotary drive, for example a rotary magnet with two adjustable end positions, is used as drive for the deflection element.

The invention is explained in further detail in the following with the aid of an exemplary embodiment and the drawing. Shown are in:

FIG. 1 A schematic view from the top of a switch for deflecting the mail items to the right conveying path.

Figure 2:
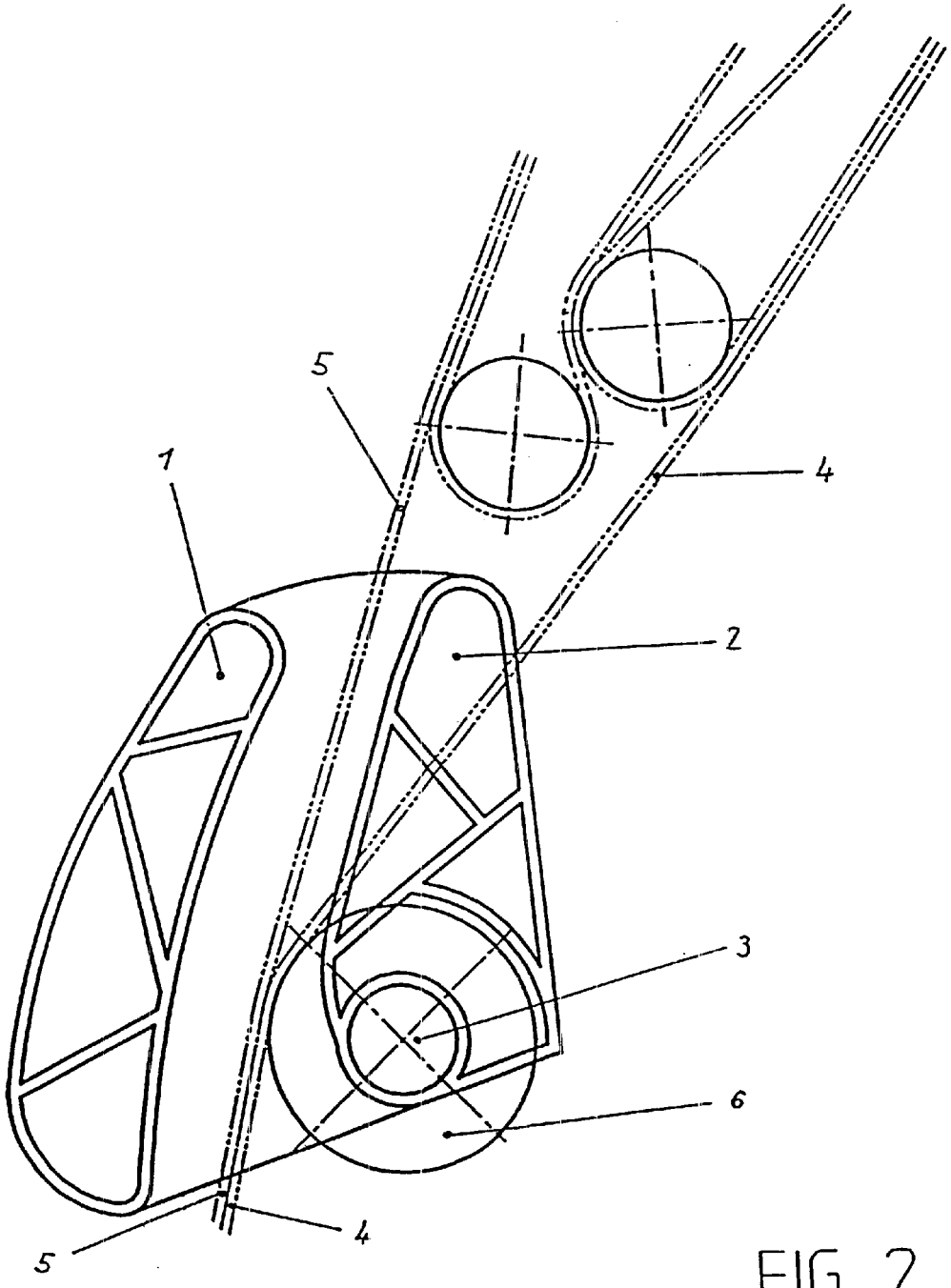

FIG. 2 A schematic view from above of a switch for deflecting the mail items to the left conveying path.

Figure 3:
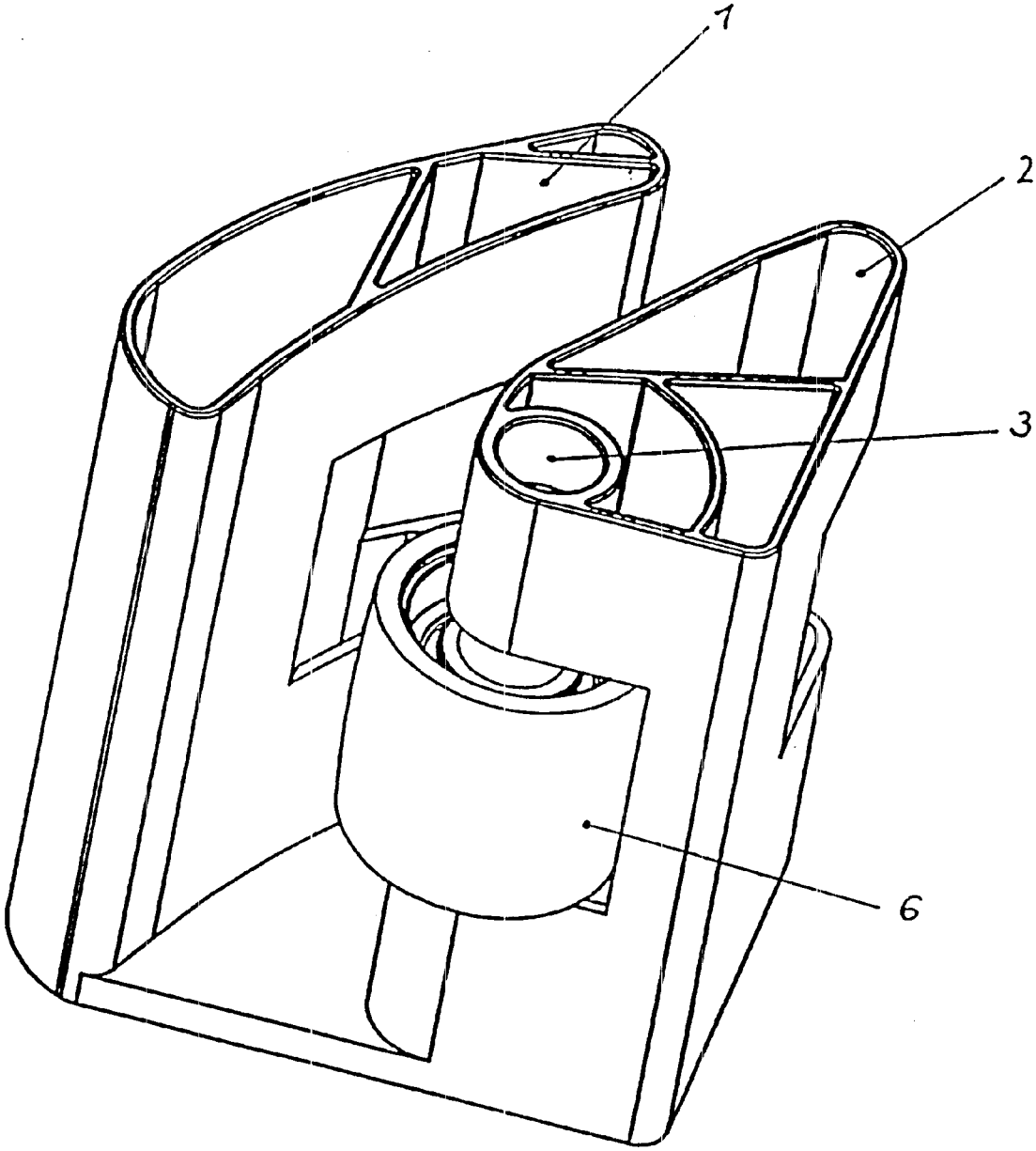

FIG. 3 A perspective representation of a switch with a joint axis for the deflection roller and the pivoting element.

With the switch shown in FIG. 1, mail items that are conveyed clamped between two conveying belts 4 and 5 are distributed to two directions. For this, the conveying belts 4, 5 diverge at a deflection roller 6 and are respectively guided to another. deflection roller over which the conveying belt is guided. Starting with these rollers, the conveying system is thus continued with two conveying belts, between which the mail items are conveyed while clamped in. The diverging conveying belts 4, 5 do not have to be continuous, but can also be separated via rollers. The pivoting axis 3 of the deflection element is located at the start of the switch region, nearly at the level of the deflection roller 6 and just on the other side of the two conveying belts 4, 5. This deflection element onsists of two rigid partial deflection elements 1, 2 that are arranged side-by-side in conveying direction and nearly parallel to each other. They are fixedly connected outside of the mail item transport plane, in this case below and via a bottom plate. The partial deflection elements 1, 2 are pivoted to the right and thus guide the mail items between the partial deflection element 1 and the conveying belt 4 to the right conveying path. The partial deflection elements 1, 2 are provided with recesses that cannot be seen in the view from above and allow these partial deflection elements to perform the pivoting movements without coming in contact with the conveyor belts 4, 5.

In FIG. 2, the partial deflection elements 1, 2 are pivoted to the left, so that the mail items are guided onto the left conveying path between the conveyor belt 5 and the partial deflection element 2. As can be seen, respectively only one partial deflection element 1 or 2 is located inside the mail item flow region, while the other partial deflection element is located outside. No obstacles exist within the mail item flow region because the pivoting axis is not arranged inside the mail item flow region, in contrast to prior art, but is located to the side of it. As a result, bent and buckling mail items in particular can pass freely through the switch region. If the gaps between mail items are to be as small as possible, then the switch must be switched before the preceding mail item has left the switch region completely. In the process, the rear section of the preceding mail items is bent in the other direction, which prevents the mail items from being pressed against the conveyor belts, thus causing malfunctions, as described in the explanation of prior art.

FIG. 3 shows a perspective view of the switch without conveyor belts. In order to simplify, the pivoting axis 3 of the partial deflection elements 1, 2 and the rotational axis for deflection roller 6 are combined. Also, the recesses in the partial deflection elements 1, 2 for the conveyor belts are easy to see in this representation.

What is claimed is:

1. A switch for flat, flexible mail items in a mail item sorting machine, wherein the mail items are optionally transported off in one of two directions with their side surfaces clamped between two conveying belts of a twin belt system, the width of the conveying belts is less than the height of the clamped in mail items, a deflection element is provided with a recess for the conveying belts, so that it can be pivoted in the direction of the conveying belts for transporting off, characterized in that the deflection element consists of two rigid partial deflection elements (1, 2) that are arranged side-by-side in conveying direction, are fixedly connected outside of the letter flow and have a joint pivoting axis (3), between which the mail items can be guided, that the joint pivoting axis (3) is located in the front switch area and to the side of the conveying belts (4, 5) that diverge in the switch region, as seen in conveying direction, wherein depending on the switch position, the respective mail item is guided in the selected direction between one of the two partial deflection elements (1, 2) and the respective outer conveying belt (4, 5) and wherein the other partial deflection element (1, 2) in that case is located completely outside of the conveying belts (4, 5) that diverge in the switch region.

2. A switch according to claim 1, characterized in that at the start of the switch region, the continuous conveying belts (4, 5) are deflected on a deflection roller (6) to the transporting-off directions and that the axis for the deflection roller (6) simultaneously functions as pivoting axis (3) of the deflection element (1, 2).

3. A switch according to claim 1, characterized in that a rotary drive that can be actuated and has two adjustable end positions is provided as pivoting element drive.

* * * * *